United States Patent [19]

Lowery

[11] Patent Number: 4,457,549

[45] Date of Patent: Jul. 3, 1984

[54] BAG MOUTH HOLDER

[76] Inventor: John Lowery, 1008 Douglas MacArthur Rd., NW., Albuquerque, N. Mex. 87107

[21] Appl. No.: 464,520

[22] Filed: Feb. 7, 1983

[51] Int. Cl.[3] ..... A47F 13/08

[52] U.S. Cl. ..... 294/55; 294/19 R; 294/1 BA

[58] Field of Search ..... 294/55, 19 R, 1 R, 1 BA, 294/51, 52, 59; 15/257.1, 257.4, 257.5, 257.8; 248/99, 101

[56] References Cited

U.S. PATENT DOCUMENTS

| | | | |
|---|---|---|---|
| 2,666,662 | 1/1954 | McLead | 294/55 |
| 3,711,141 | 1/1973 | Soergel | 294/55 |
| 4,149,745 | 4/1979 | Willis | 294/1 BA |
| 4,270,788 | 6/1981 | Overholt | 294/55 |

*Primary Examiner*—James B. Marbert

*Attorney, Agent, or Firm*—Harvey B. Jacobson

[57] ABSTRACT

A peripherally continuous frame is provided for receiving the open mouth of a bag therethrough with the free edge portions of the bag mouth folded outwardly and back over the outer surfaces of the frame. Peripherally spaced portions of the frame each have one end portion of an elongated arm member pivotally anchored thereto for oscillation about an axis transverse to the arm member and the corresponding frame portion and generally paralleling the medial plane of the frame. The free end portion of each arm member includes an elongated longitudinally extending clamp portion thereof which is generally U-shaped in transverse cross section, opens laterally outwardly of the arm member and includes open opposite ends. The clamp portions are swingable into and out of positions with an adjacent frame portion embracingly received therein and extending longitudinally therealong, whereby when the free edge portion of a bag is folded outwardly and back over the adjacent frame portions they may be releasably clamped to the frame portions by the U-shaped free end portions of the arm members. The frame includes an elongated outwardly projecting handle supported from one marginal portion thereof.

10 Claims, 4 Drawing Figures

BAG MOUTH HOLDER

BACKGROUND OF THE INVENTION

When performing lawn clean up operations it is often necessary to remove large volumes of leaves or grass cuttings and the like. While grass cuttings and leaves in the past have been placed in bushel baskets for transport to a trash container storage area, bushel baskets have increased in cost to the extent that few people wish to incure the expenses now associated with the use of bushel baskets. In addition, the plastic bag industry has developed plastic bags which are now reasonably reliable against splitting and tearing and a disposable plastic bag has a considerably larger volume than one bushel basket. In addition, trash disposed of in a plastic bag does not require the return of the trash container. Accordingly, most persons who wish to rake grass clippings and leaves now use plastic bags as receptacles for the grass clippings and leaves.

However, the use of plastic bags for receiving raked grass clippings and leaves presents the problem for an individual of holding open the bag while at the same time placing the grass clippings or leaves within the bag. Accordingly, a need exists for structure by which the mouth of a large volume plastic bag or the like may be held in an open position while materials to be placed within the bag are so placed by an individual.

Examples of bag mouth holding structures as well as other similar devices including some of the general structural and operational features of the instant invention are disclosed in U.S. Pat. Nos. 3,659,891, 3,688,483, 3,711,147, 3,733,099, 3,745,785, 4,021,994 and 4,048,691.

BRIEF DESCRIPTION OF THE INVENTION

The bag mouth holder of the instant invention includes a continuously peripheral quadrilateral frame with a pair of opposite sides of the frame equipped with longitudinally spaced clamps for releasably clampingly engaging outwardly and backturned portions of a bag mouth extending through the frame. In this manner, the bag mouth is supported by the frame in an open position. The frame is equipped with an elongated handle and support foot structure whereby the frame may be positioned on the ground in an upstanding position with the associated bag opening in a horizontal direction. In this manner, grass clippings and leaves may be readily advanced into the open mouth of the bag.

The main object of this invention is to provide a bag mouth holder which will be capable of supporting a plastic bag mouth or the like in an open position while grass clippings and leaves or other debris may be placed within the bag.

Another object of this invention is to provide a bag mouth holder including structure whereby the associated bag mouth may be supported in position with the bag opening in a horizontal direction while disposed on the ground.

Still another important object of this invention is to provide a bag mouth holder including releasable clamp structure for clampingly engaging peripherally spaced portions of the mouth of the associated bag.

A final object of this invention to be specifically enumerated herein is to provide a bag mouth holder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings the numeral 10 generally designates the mouth bag holder of the instant invention.

Figure 2:
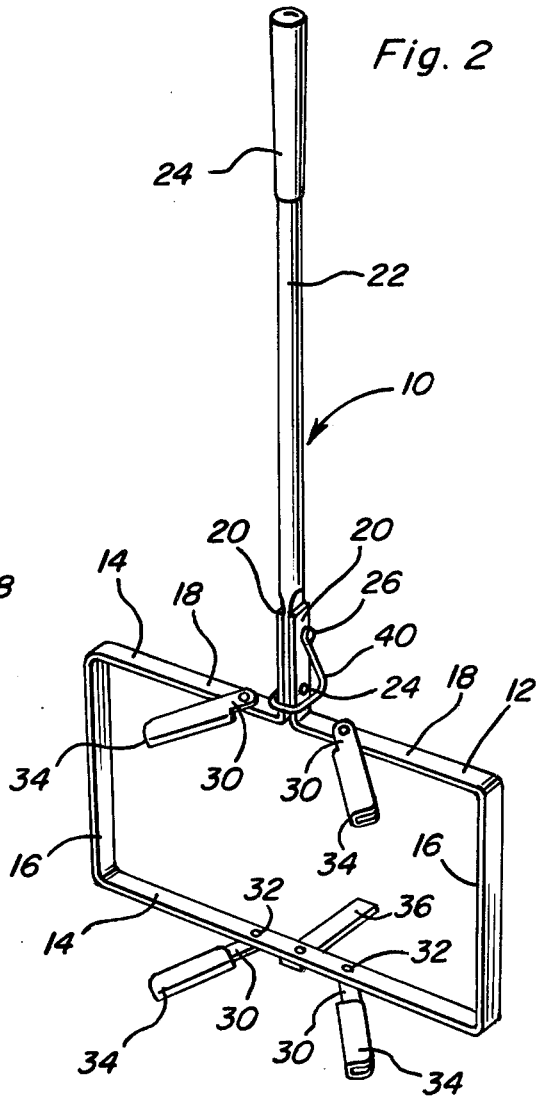
FIG. 2 is an enlarged perspective view of the holder.

The bag mouth holder may best be seen in FIG. 2 of the drawings as including a quadralateral peripheral frame 12 having first and second pairs of opposite long and short sides 14 and 16. One of the sides 14 comprises a pair of side end sections 18 with out turned adjacent ends 20 having one flattened end of an elongated handle 22 clampingly secured therebetween through the utilization of suitable fasteners 24 and 26. The other free end of the handle 22 is equipped with a hand grip 24 and when the adjacent ends 20 are clamp engaged with the flattened end of the handle 22 the end sections 18 define one long side of the frame 12.

Each of the long sides of the frame 12 includes pairs of longitudinally spaced elongated arm members 30 pivotally supported therefrom by suitable pivot fasteners 32 and the arm members 30 each include outer free end portions 34 which are generally U-shaped in transverse cross section and open laterally outwardly of the corresponding arm member. The arm members 30 are swingable between the outwardly extending inoperative positions illustrated in FIG. 2 of the drawings and positions with the U-shaped end portions 34 closely embracing the corresponding portions of the long frame sides, see FIGS. 1, 3 and 4. Further, the lower long side 14 of the frame 12 illustrated in FIG. 2 includes a pivoted foot portion 36 which extends laterally outwardly of the central portion and enables the frame 12 to be supported in an upright position from a horizontal support surface such as the surface 38 illustrated in FIG. 3. Further, a U-shaped spring clip 40 is pivotally supported from the fastener 26 for purposes to be hereinafter to be more fully set forth.

Figure 1:
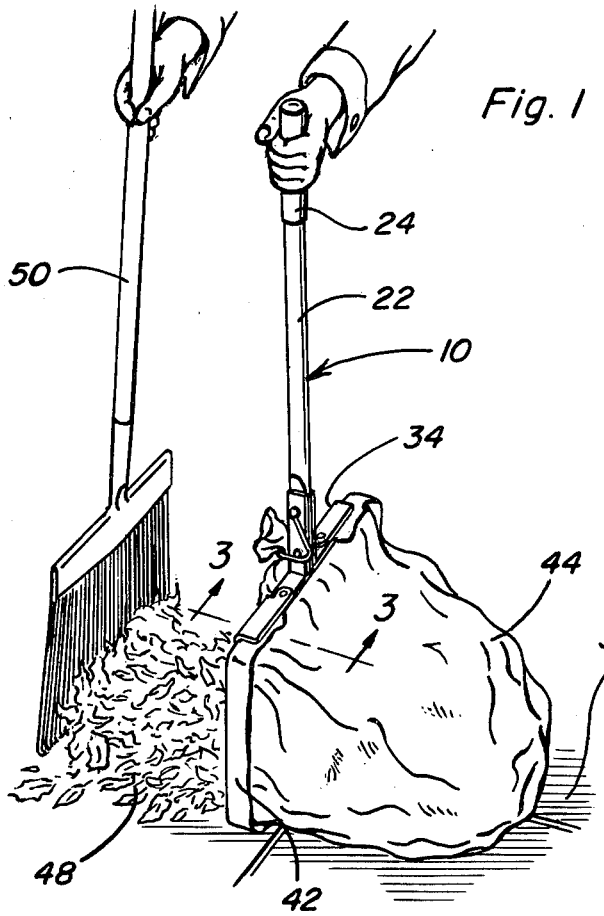
FIG. 1 is a perspective view of the bag mouth holder and an associated bag disposed in horizontal position upon the ground and having leaves raked into the open mouth of the bag.
Figure 3:
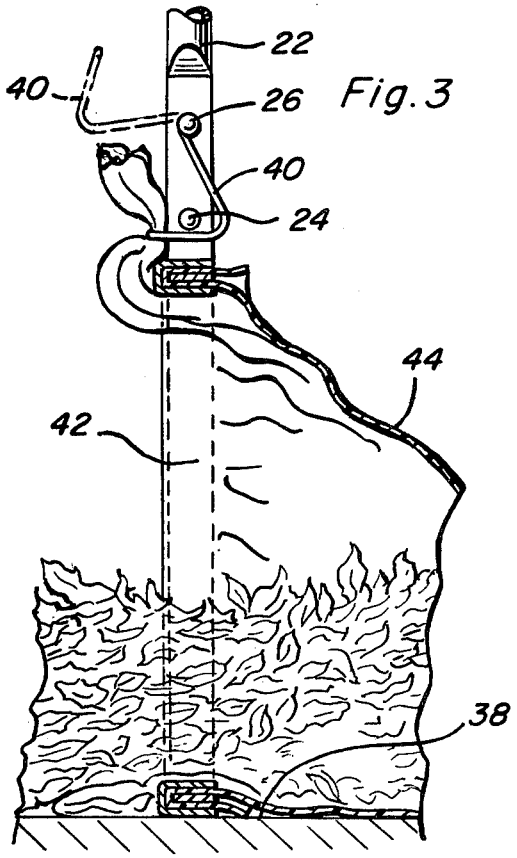
FIG. 3 is an enlarged fragmentary vertical sectional view taken substantially upon the plane indicated by the section line 3—3 of FIG. 1.
Figure 4:
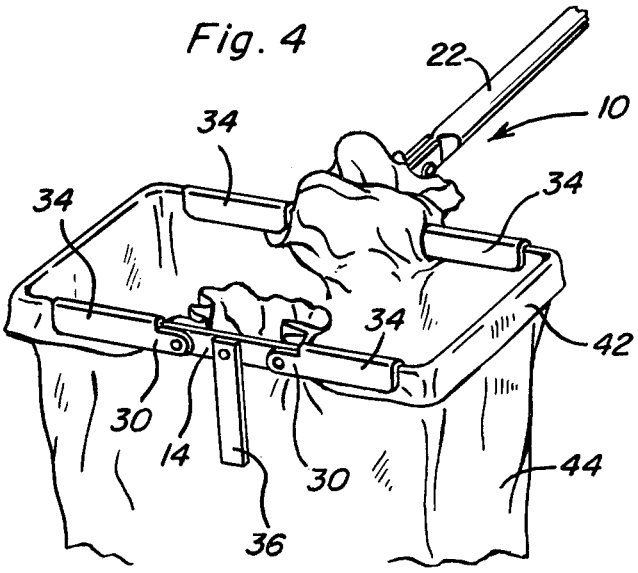
FIG. 4 is a fragmentary perspective view of the bag mouth holder in horizontal position and with the associated bag opening in an upward direction.

With attention now invited more specifically to FIGS. 1, 3 and 4 of the drawings, it may be seen that the open mouth end 42 of a plastic bag 44 may be placed through the frame 12 and the free marginal edges of the mouth end 42 of the bag 44 may be deflected outwardly and back over the frame sides 14 and 16. Then, the arm members 30 may be swung from the inoperative positions thereof illustrated in FIG. 2 to the operative positions thereof illustrated in FIGS. 1, 3 and 4 of the drawings with the out and back turned free marginal edge of the mouth end of the bag 44 clamped between the channel shaped end portions 34 and the long sides 14 of the frame 12. In this matter, the open mouth end of the bag 44 may be supported in a full open position in order to receive raked leaves 48 therein while the user of the holder 10 grips the hand grip 24 in one hand and a rake 50 in the other hand, see FIG. 1.

The clamp 40 clampingly engages that marginal portion of the mouth end of the bag 44 which bridges between the end sections 18 of the upper side 14 and about the lower end of the handle. In this manner, the bag 44 may have its mouth supported in a full open position to receive the leaves 48 (or grass cuttings and the like) therein. Of course, the holder 10 may also be used in conjunction with paper bags and may be constructed of any size to accomodate a particular size bag.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holder for the mouth of a bag, said holder including a peripherally continuous frame adapted to receive the open mouth of a bag therethrough with the free portions of said mouth folded outwardly and back over the outer surfaces of said frame, peripherally spaced portions of said frame each having one end of an elongated arm member pivotally anchored thereto for oscillation about an axis transverse to said arm member and the corresponding frame portion, the free end portion of each arm member including an elongated longitudinally extending clamp portion spaced along the arm member from the corresponding axis and which is generally U-shaped in transverse cross section, opens laterally outwardly of the arm member in a direction transverse to the pivot axis thereof and includes open ends, said clamp portions being swingable into and out of positions with an adjacent frame portion embracingly received therein and extending longitudinally therealong, whereby when the free edge portion of a bag is folded outwardly and back over said adjacent frame portion the last mentioned free edge portion may be releasably clamped to said adjacent frame portion.

2. The holder of claim 1 wherein said frame comprises a quadralateral polygon in plan shape.

3. The holder of claim 2 wherein each of a pair of opposite sides of said frame includes a pair of arm members supported therefrom.

4. The holder of claim 1 wherein the axes of oscillation of said arm members relative to said frame are disposed in the medial plane of said frame.

5. The holder of claim 1 wherein one side of said frame is generally straight and includes an intermediate length portion thereof supporting a transversely extending foot structure disposed generally normal to the medial plane of said frame.

6. The holder of claim 5 wherein said frame includes a further side remote from said one side, said further side including an intermediate length portion thereof supporting an elongated outwardly projecting handle therefrom.

7. The holder of claim 6 wherein said handle substantially parallels the medial plane of said frame.

8. The holder of claim 7 wherein said frame comprises a quadralateral polygon in plan shape.

9. The holder of claim 8 wherein each of a pair of opposite sides of said frame includes a pair of arm members supported therefrom.

10. The combination of claim 9 wherein the axes of oscillation of said arm members relative to said frame are disposed in the medial plane of said frame.

* * * * *